United States Patent [19]

Collier et al.

[11] Patent Number: 4,865,561

[45] Date of Patent: Sep. 12, 1989

[54] PTC ADAPTOR

[75] Inventors: John C. Collier, Skelmersdale; Stuart J. Reeves, St. Helens, both of Great Britain

[73] Assignee: BICC Public Limited Company, London, Great Britain

[21] Appl. No.: 156,747

[22] Filed: Feb. 18, 1988

[30] Foreign Application Priority Data

Feb. 20, 1987 [GB] United Kingdom ..... 8703972

[51] Int. Cl.[4] ..... H01R 4/24

[52] U.S. Cl. ..... 439/391; 439/638; 439/676; 439/425

[58] Field of Search ..... 439/425, 638, 639, 640, 439/650–655, 395, 396, 425, 676, 344, 389–405

[56] References Cited

U.S. PATENT DOCUMENTS

| | | | |
|---|---|---|---|
| 2,645,760 | 7/1953 | Fortino | 439/654 |
| 4,241,974 | 12/1980 | Hardesty | 439/638 |
| 4,362,905 | 12/1982 | Ismail | 439/653 |
| 4,438,998 | 3/1984 | Myers | 439/638 |
| 4,444,451 | 4/1984 | Meyers | 439/638 |
| 4,462,656 | 7/1984 | Beyer | 439/655 |
| 4,611,875 | 9/1986 | Clarke et al. | 439/638 |

FOREIGN PATENT DOCUMENTS 0018654 9/1983 European Pat. Off. .

*Primary Examiner*—David Pirlot
*Attorney, Agent, or Firm*—Thomas L. Peterson

[57] ABSTRACT

A PTC adaptor for a pluggable data connector socket comprises an insulating housing (1) including a plug region (6) for insertion into the pluggable data connector socket, a socket region (16) including a plug receiving cavity (21) in which a pluggable data connector may be received, and a cord receiving region including a cavity (9) in which a plurality of insulated conductors may be received. The housing further includes a plurality of electrical contacts (24), each contact comprising a plug portion (26) extending into the plug region (6) for making an electrical connection with the pluggable data connector socket, a socket portion (28) extending into the plug receiving cavity (21), and a terminating portion (27) extending into the cord receiving cavity (9) for penetrating the insulating covering of the insulated conductors to make an electrical connection with the conductors therein.

7 Claims, 4 Drawing Sheets

PTC ADAPTOR

BACKGROUND AND SUMMARY OF THE INVENTION

This invention relates to adaptors for pluggable data connector sockets, to enable one or more pluggable connectors together with an additional cord, to be connected to a single pluggable data connector socket. By the term pluggable data connector or pluggable telecommunications connector (PTC) there is herein meant to include any pluggable connector for use in telecommunications in general, including telephone, telex, computer data links, etc,.

An adaptor for pluggable telephone connector sockets is known which comprises a housing in which is contained a printed circuit board with various components such as sockets, plugs, wires, etc attached thereto. EP0018654 describes an adaptor in which two pluggable telephone connectors may be received, wire-like contacts extending from one connector to the other. It is an object of the present invention to provide an improvement to this type of adaptor.

Accordingly there is provided an adaptor for a pluggable data connector socket, the adaptor comprising an insulating housing, the housing comprising a plug region adapted to be received within an associated pluggable data connector socket, at least one socket region including a plug receiving cavity and an aperture through which an associated pluggable data connector may be introduced into the plug receiving cavity, and a cord receiving region including a cord receiving cavity and an associated entrance through which a plurality of insulated conductors may be introduced into the cord receiving cavity; and a plurality of contacts, each contact comprising a plug portion received within the plug region of the housing and being adaped to make an electrical connection with a corresponding contact of the associated pluggable data connector socket, at least one socket portion extending into the plug receiving cavity of a socket region of the housing and being adapted to make an electrical connection with a corresponding contact of the associated pluggable data connector when it is introduced into the plug receiving cavity, and a terminating portion extending into the cord receiving cavity and being adapted to penetrate the insulating covering of one of the insulated conductors to make an electrical connection with the conductor therein; wherein the plug portion, the or each socket portion and the terminating portion are all provided by a single integral contact.

This type of adaptor allows an additional cord to be connected to a socket, thereby allowing further remote sockets to be installed if required. This may, for example, be used to provide extension telephone sockets in addition to the master line jack unit.

Conceivably the plug portion, the or each socket portion and the terminating portion are welded one to another to form an integral contact. More preferably each of the plurality of contacts comprises an integral stamped and formed contact. By whichever method the integral contacts are formed, there is provided an adaptor in which all the electrical connections are made via a plurality of single integral contacts, and the requirement for a circuit board and other components is thereby eliminated.

Conveniently there is provided an additional plug receiving cavity in which an additional pluggable data connector may be received, and each contact includes an additional socket portion extending into the additional plug receiving cavity and being adapted to make an electrical connection with the corresponding contact of the additional pluggable data connector when it is introduced into the additional plug receiving cavity. With this type of adaptor more than one piece of telecommunications equipment may be connected to a single socket.

The terminating portion of each contact which is used to penetrate the insulating covering of the insulated conductors is conveniently either an Insulation Piercing (IPC) Contact or an Insultion Displacement (IDC) Contact.

In one convenient arrangement there is provided an adaptor for a pluggable data connector socket, the adaptor comprising an insulating housing, the housing comprising a plug region adapted to be received within an associated pluggable data connector socket, first and second socket regions each including a plug receiving cavity and an aperture through which an associated pluggable data connector may be introduced into a respective plug receiving cavity, and a cord termination region including a cord receiving cavity and an associated aperture through which a plurality of insulated conductors may be introduced into the cord receiving cavity; and a plurality of contacts, each contact comprising a plug portion received within the plug region of the housing and being adapted to make an electrical connection with a corresponding contact of the associated pluggable data connector socket, first and second socket portions one extending into each plug receiving cavity of the first and second socket regions of the housing and each being adapted to make an electrical connection with the corresponding contact of an associated pluggable data connector when it is introduced into a respective plug receiving cavity, and a terminating portion extending into the cord receiving cavity and being adapted to penetrate the insulating covering of one of the insulated conductors and make an electrical connection with a conductor therein; wherein the plug portion, the first and second socket portions and the terminating portion are all provided by a single integral contact.

This arrangement of adaptor provides both a second local socket, and an additional cord connection to enable further remote sockets to be installed.

BRIEF DESCRIPTION OF THE DRAWINGS

The invention will now be further described, by way of example only, with refernce to the accompanying drawings, in which.

DETAILED DESCRIPTION OF THE PREFERRED EMBODIMENTS

Figure 1:
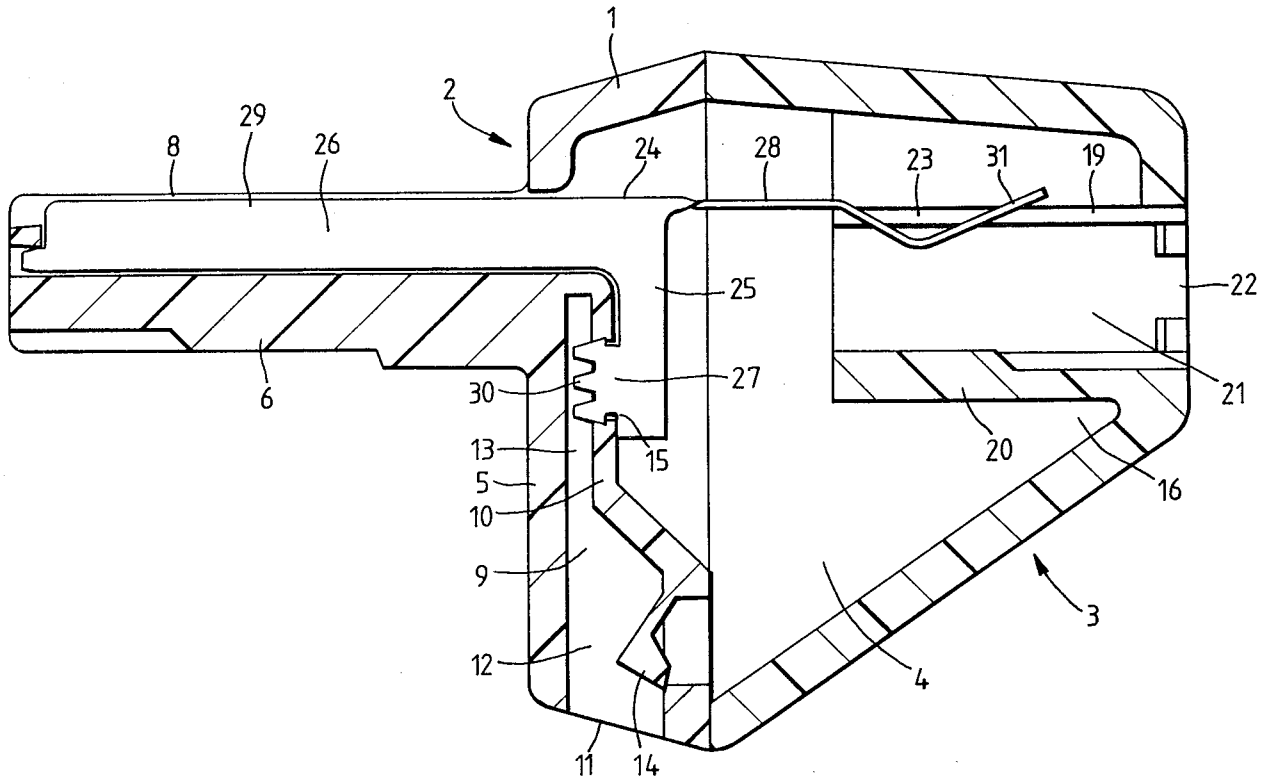
FIG. 1 is a cross-sectional elevation of an adaptor according to the invention.
Figure 2:
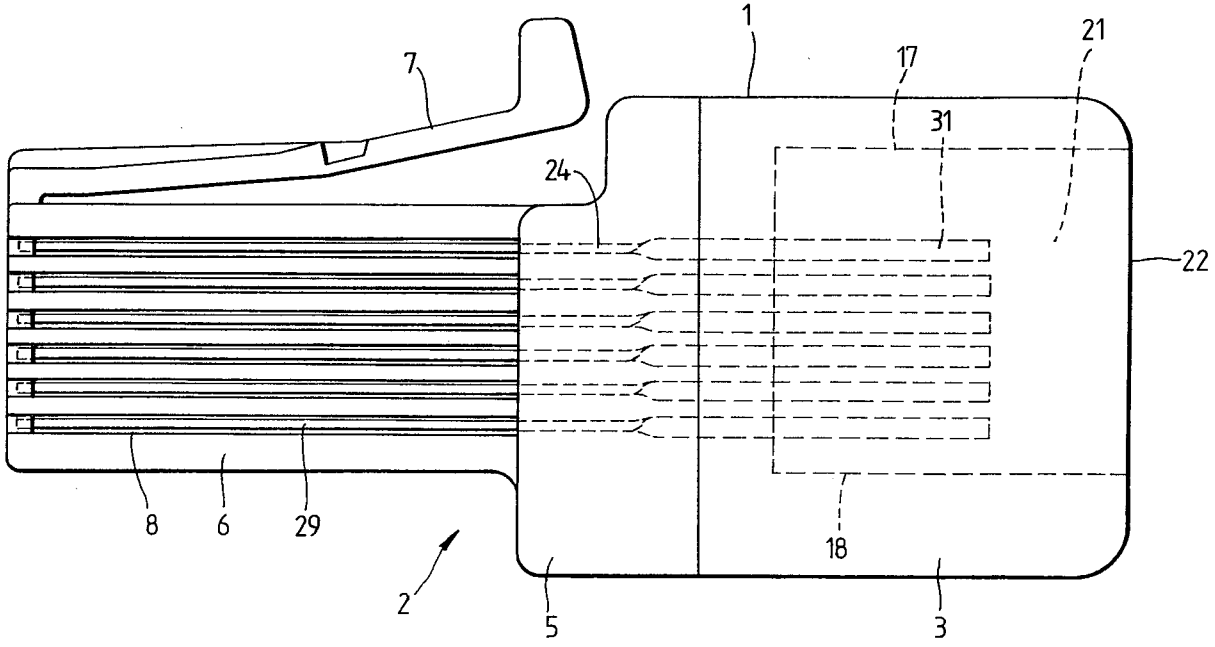
FIG. 2 is a plan view of the adaptor of FIG. 1.

Referring to FIGS. 1 and 2, the adaptor comprises an insulating housing 1 of a moulded plastics material. The housing is hollow, and includes a rear part 2 and a front part 3, interfitting one with the other to define a chamber 4 therein. The rear part 2 comprises a body portion 5 and a plug region 6 extending therefrom. The plug region 6 includes a latching arm 7 and includes parallel slots 8 communicating between the chamber 4 and the exterior of the plug region.

The rear part 2 also includes a cord receiving compartment 9, separated from the interior chamber 4 by means of sidewall 10. The compartment is open to the exterior of the adaptor through entrance 11, and comprises a relatively broad section 12 adjacent thereto, and a relatively narrow section 13 towards the interior of the adaptor. Adjacent the broad section 12, the sidewall 10 is provided with a strain relief member 14, hingeably movable into the compartment 9. Adjacent the narrow section 13, the sidewall 10 is provided with slots 15 communicating between the compartment 9 and the chamber 4.

The front part 3 further defines the chamber 4, and is provided with a socket region 16. The socket region comprises sidewalls 17, 18, upper wall 19, and lower wall 20, which between them define a plug receiving cavity 21. The cavity 21 communicates with the exterior of the adaptor by means of entrance 22. The upper wall 19 of the socket region is provided with slots 23 by means of which the cavity 21 communicates with the interior chamber 4 of the adaptor.

A plurality of metallic contacts 24 are housed within the chamber 4. The contacts are each of an integral construction, and comprise a body portion 25 from which extends a plug portion 26, a terminating portion 27, and a socket portion 28. The plug portion 26 comprises an elongate blade section 29, dimensioned so as to be received wholly within one of the slots 8 of the plug region 6. The terminating portion 27 comprises three sharp-edged tines 30, dimensioned so as to be insertable through the slots 15 to protrude into the relatively narrow section 13 of the cord receiving compartment 9. The socket portion 28 comprises a wire-like contact arm 31 which extends through the slots 23 into the plug receiving cavity 21.

A plurality of insulated conductors (not shown) are terminated by the terminating portions 27 of the contacts 24. To terminate the conductors the two parts 2 and 3 of the adaptor are separated and the insulated conductors inserted into the compartment 9, the wide section 12 accommodating the sheathed cable and the narrow part 13 accommodating the insulated conductors extending thereform. The contacts 24 are moved with respect to the rear part 2, with the aid of a tool (not shown), so that the tines 30 protrude into the compartment 9 to penetrate the insulating covering of the insulated conductors to make an electrical connection with the electrical conductors therein. The strain relief member 14 is also moved into the compartment 9, in order to grip the sheathed cable and prevent undesired movement thereof. The conductors being terminated, the two parts of the adaptor can be re-assembled.

In use the plug region 6 of the adaptor is received within a pluggable data socket such as a telephone socket (not shown), with the blade sections 29 of the contacts 24 engaging and making an electrical connection with the contacts of the telephone socket. A pluggable data connector such as a telephone plug (not shown) is received within the cavity 21, with its contacts engaging the contact arms 31 to make an electrical connection therewith. The contacts of the telephone socket are therefore not only in electrical connection with those of the telephone plug received within the cavity 21, but also with the insulated conductors by virtue of the terminating portions 27. In this way the adaptor provides an additional cord connection to enable further remote sockets to be installed.

Figure 3:
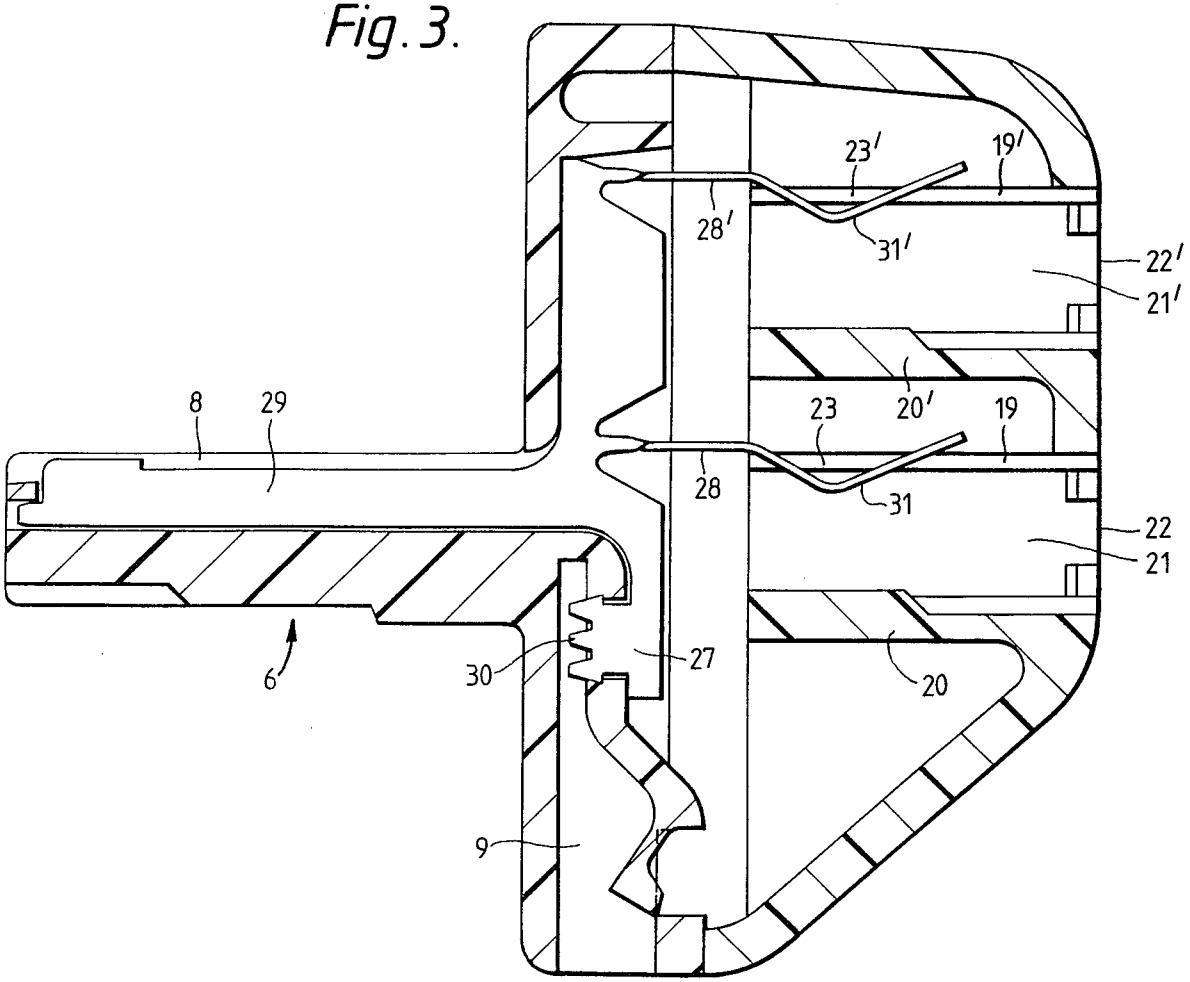
FIG. 3 is a cross-sectional elevation of an adaptor according to an alternative embodiment of the invention.
Figure 4:
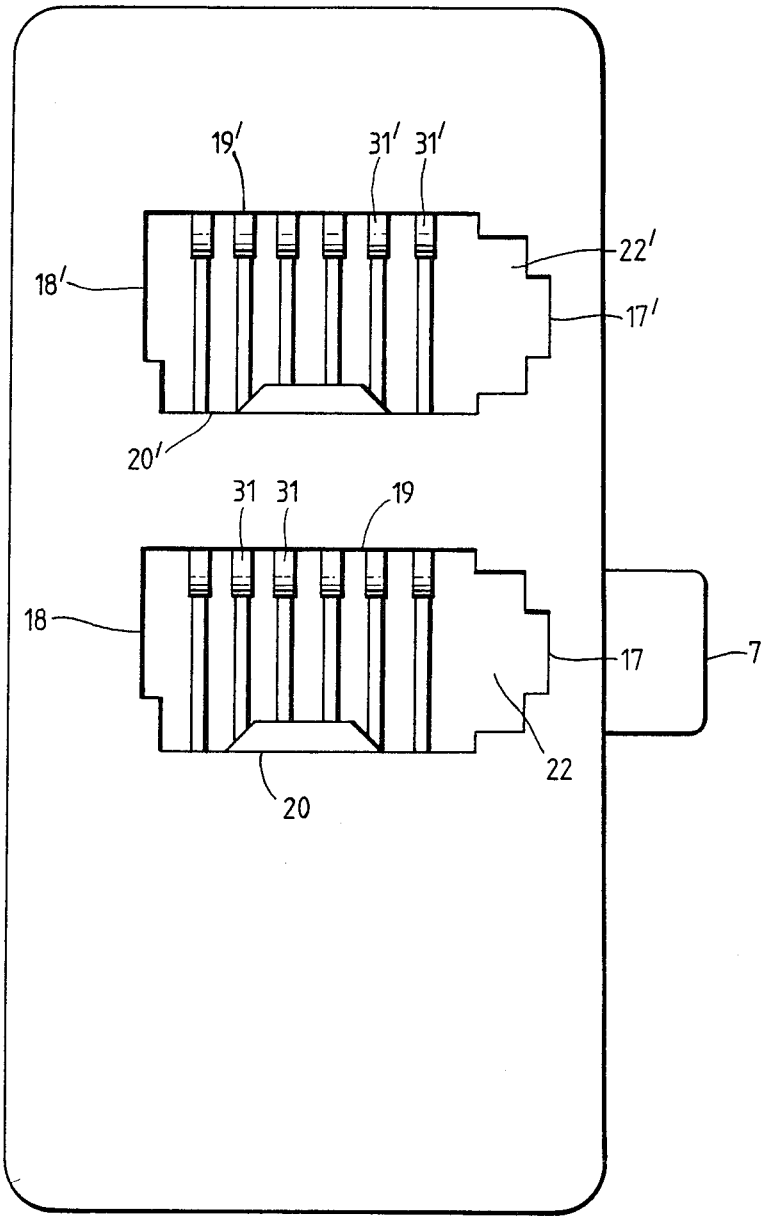
FIG. 4 is an end elevation of the adaptor of FIG. 3.

FIGS. 3 and 4 show an alternative embodiment of adaptor in which like features are designated with like reference numerals. The plug region 6 and the terminating portion 27 are as before, but the socket region 16 comprises, in addition to the plug receiving cavity 21, a second plug receiving cavity 21′ together with the associated defining walls 17′,18′, 19′ and 20′. Similarly the contacts include an additional socket portion 28′ comprising a second wire-like contact arm 31′. This arrangement allows two telephone plugs, as well as the additional telephone cord, to be connected to a single socket.

We claim:

1. An adaptor for connection of a plurality of insulated conductors, at least one pluggable data connector, and a pluggable data connector socket, the adaptor comprising:

an insulating housing defining a longitudinal axis, the housing comprising a plug region at a first longitudinal end of the housing and receivable within the pluggable data connector socket, at least one socket region at a second opposite longitudinal end of the housing and including a plug receiving cavity and an aperture through which the pluggable data connector may be introduced into the plug receiving cavity, and a cord receiving region traversing the longitudinal axis of the housing between the first and second longitudinal ends, and including a cord receiving cavity and an associated entrance through which the plurality of insulated conductors may be introduced into the cord receiving cavity; and a plurality of contacts, each contact comprising a plug portion adjacent the first longitudinal housing end, and received within the plug region of the housing and having means for making an electrical connection with the pluggable data connector socket, at least one socket portion adjacent the second longitudinal housing end, and extending into the plug receiving cavity of a corresponding at least one socket region of the housing and having means for making an electrical connection with the pluggable data connector when it is introduced into the plug receiving cavity, and a terminating portion extending into the cord receiving cavity and having penetrating means for penetrating the insulating covering of one of the insulated conductors to make an electrical connection with the conductor therein as the contact is inserted into the cord receiving cavity;

wherein the plug portion, the at least one socket portion and the terminating portion are all provided by a single integral contact.

2. An adaptor according to claim 1 wherein each of the plurality of contacts comprises an integral stamped and formed contact.

3. An adaptor according to claim 1 wherein each of the plurality of contacts comprises an integral contact wherein the plug portion, the at least one socket portion and the terminating portion are welded one to another.

4. An adaptor according to claim 1 wherein there is provided an additional plug receiving cavity in which an additional pluggable data connector may be received, and each contact includes an additional socket portion extending into the additional plug receiving cavity and having means for making an electrical connection with a corresponding contact of the additional pluggable data connector when it is introduced into the additional plug receiving cavity.

5. An adaptor according to claim 1 wherein the terminating portion comprises an insulation piercing contact.

6. An adaptor according to claim 1 wherein the terminating portion comprises an insulation displacement contact.

7. An adaptor for the connection of a plurality of insulated conductors, first and second pluggable data connectors, and a pluggable data connector socket, the adaptor comprising:

an insulating housing defining a longitudinal axis, the housing comprising a plug region at first longitudinal end of the housing and receivable within the pluggable data connector socket, first and second socket regions at a second opposite longitudinal end of the housing and each including a plug receiving cavity and an aperture through which either of the first and second pluggable data connectors may be introduced into a respective plug receiving cavity, and a cord termination region traversing the longitudinal axis of the housing between the first and second longitudinal ends, and including a cord receiving cavity and an associated aperture through which the plurality of insulated conductors may be introduced into the cord receiving cavity; and a plurality of contacts, each contact comprising a plug portion adjacent the first longitudinal housing end, and received within the plug region of the housing and having means for making an electrical connection with the pluggable data connector socket, first and second socket portions adjacent the second longitudinal housing end, one socket portion extending into each plug receiving cavity of the first and second socket regions of the housing and each having means for making an electrical connection with one of the first and second pluggable data connectors when they are introduced into a respective plug receiving cavity, and a terminating portion extending into the cord receiving cavity and having penetrating means for penetrating the insulating covering of one of the insulated conductors and make an electrical connection with a conductor therein as the contact is inserted into the cord receiving cavity;

wherein the plug portion, the first and second socket portions and the terminating portion are all provided by a single integral contact.

* * * * *